US006713971B1

(12) United States Patent
Wong

(10) Patent No.: US 6,713,971 B1
(45) Date of Patent: Mar. 30, 2004

(54) LAMP STRING WITH AN OPEN-CIRCUIT-PROOF STRUCTURE

(76) Inventor: Pi-Chu Wong, P.O. Box 96-405, Taipei 106 (TW)

( * ) Notice: Subject to any disclaimer, the term of this patent is extended or adjusted under 35 U.S.C. 154(b) by 0 days.

(21) Appl. No.: 10/341,978

(22) Filed: Jan. 9, 2003

(51) Int. Cl.[7] ..... H05B 37/00; F21V 15/00

(52) U.S. Cl. ..... 315/185 S; 315/56; 362/377; 362/376

(58) Field of Search ..... 315/185 S, 56, 315/57, 58, 312, 324; 362/377, 376, 378, 800, 806

(56) References Cited

U.S. PATENT DOCUMENTS 4,223,248 A * 9/1980 Tong ..... 315/185 S 4,227,228 A * 10/1980 Cheng ..... 361/104

* cited by examiner

*Primary Examiner*—Tuyet T. Vo

(57) ABSTRACT

A lamp string with an open-circuit-proof structure, which comprises a socket, a bulb receptacle, a bulb and a fuse assembly; the center hole of the socket is furnished with a rectangular cavity for receiving a fuse assembly, and an outer rectangular cavity for mounting bulb receptacle plugged with a bulb; the center of the socket is furnished with a fuse assembly; in case of the tungsten filament of a bulb being burned out, or a bulb receptacle of a socket being lost, the power-supply circuit can still be maintained in a closed circuit condition through the fuse assembly, i.e., the whole lamp string can be always in lighting-up condition.

6 Claims, 11 Drawing Sheets

LAMP STRING WITH AN OPEN-CIRCUIT-PROOF STRUCTURE

BACKGROUND OF THE INVENTION

1. Field of the Invention

This invention relates to a Christmas lamp, and particularly to a lamp string with an open-circuit-proof structure.

2. Description of the Prior Art

In a conventional Christmas lamp string, a plurality of separate lamp strings is connected in series into a long lamp string; in the separate lamp string, a power-supply wire having a suitable length is used to connect between two lamp assemblies in series; the first lamp assembly and the last lamp assembly are connected with different length of two power-supply wires to a plug; then, the whole lamp assemblies and the power-supply wires are twisted into a separate lamp string.

Each lamp assembly in one lamp string includes a socket, a bulb receptacle, and a bulb. In order to facilitate removing or replacement of a bulb, the bulb is usually mounted in a bulb receptacle, and then the bulb receptacle is plugged into the rectangular cavity of a socket. The number of lamp assemblies and the resistance of each lamp assembly are designed in advance in accordance with the voltage and current values of a local area.

In order to prevent the power-supply wire from being overloaded, or from having a short-circuit to cause a danger, the socket of each lamp string must be furnished with a fuse wire; however, the fuse wire in the socket is not designed in accordance with the overload value of the lamp assembly.

Each bulb of every lamp assembly has a glass positioning bead welded around two parallel magnesium-plating filaments; the short section of two filaments at one end of the positioning bead is connected with a tungsten filament, while the other end of the positioning bead has two longer filaments pulled out of the bulb sealed; the magnesium-plating filaments are plugged into the center hole of the bulb receptacle, and then the two filaments are bent and attached along two planes on both sides of the bulb receptacle respectively; after the bulb receptacle is plugged into the center hole of the socket, the filaments on both sides of the bulb receptacle will be in contact with the contact copper plates of the power-supply wires respectively; in such a lamp string, if the tungsten filament of only one bulb is burned out or one bulb is lost, the whole lamp string will be turned off because of the circuit is opened.

In order to prevent the aforesaid open circuit from taking place, a fuse made of aluminum of 0.065 m/m is wound around the two filaments on the outer end of the positioning bead before the tungsten filament being mounted on the tail ends of the two filaments; the number of turns of the fuse wire is at least 2.5 turns so as to enable the aluminum fuse fastened in place. The purpose of furnishing the aluminum fuse is to prevent the lamp string from suffering an open circuit in case of the tungsten filament in a bulb being burned out, i.e., the low resistance fuse will maintain the two bulb filaments in a conduction state to keep the whole lamp string in lighting-up condition.

When one bulb in the lamp string is lost, a new bulb must be mounted therein; in case of no such bulb being available, the replacement has to be abandoned.

SUMMARY OF THE INVENTION

The prime object of the present invention is to provide a lamp string with an open-circuit-proof structure, in which each lamp assembly in a lamp string has a center hole; the center is furnished with rectangular cavity for mounting a fuse assembly; the outer rectangular cavity in the center hole is used for mounting a bulb receptacle with a bulb; since the socket is furnished with a fuse assembly, the whole lamp string will always be maintained in lighting-up condition in case of the tungsten filament of a bulb in the lamp string being burned out, or one of the bulb receptacle of the socket being lost because of the power-supply circuit being maintained in conduction condition by means of the fuse assembly.

Another object of the present invention is to provide a lamp string with an open-circuit-proof structure, in which the fuse assembly mounted in the center hole of the socket includes a fuse member and a fastening member; the fuse member has a positioning bead, which is used for fastening the two parallel magnesium-plating filaments in place; the short section of the two magnesium-plating filaments is wound with a fuse made of aluminum, while the longer section of the two magnesium-plating filaments extend the through slots of the fastening member; then, the tail ends thereof are bent and attached to the two planes respectively. The two bent magnesium-plating filaments of the fuse assembly are in contact with the contact copper plates respectively; in case of the bulb receptacle being lost or the tungsten filament of a bulb being burned out, the power supply of the lamp assembly can still maintained in conduction condition through the magnesium-plating filaments of the fuse assembly.

Still another object of the present invention is to provide a lamp string with an open-circuit-proof structure, in which a rectangular cavity is furnished under a rectangular cavity to mount the bulb receptacle, and it is used for mounting a fuse assembly; such fuse assembly would not hinder the bulb receptacle to plug in place.

A further object of the present invention is to provide a lamp string with an open-circuit-proof structure, in which a fuse assembly is mounted in the center hole of the socket; the tail ends of the two magnesium-plating filaments are mounted with tungsten filament directly without winding aluminum fuse wire around the two magnesium-plating filaments.

A still further object of the present invention is to provide a lamp string with an open-circuit-proof structure, in which the center of the fastening member in the fuse assembly has a recess, under which two through slots are furnished on both sides thereof; the two through slots are used to have the two longer section of magnesium-plating filaments passed through; the tail ends of the magnesium-plating filaments are bent and attached to the planes respectively; the recess in the center thereof is used for mounting the positioning bead so as to prevent the fuse member from moving unintentionally as a result of shaking.

Yet another object of the present invention is to provide a lamp string with an open-circuit-proof structure, in which the longer section of the two magnesium-plating filaments at one end of the positioning bead is wound with aluminum fuse wire of 0.065 m/m at least 2.5 turns; normally, the aluminum fuse wire would not hinder the current flowing in the tungsten filament of the bulb; in case of the tungsten filament of a bulb being burned out or a bulb receptacle being lost, the low resistance aluminum fuse wire will maintain the power supply in a closed circuit condition and the whole lamp string will still be in lighting up condition.

Yet still another object of the present invention is to provide a lamp string with an open-circuit-proof structure, in which the fastening member of the fuse assembly is substantially a rectangular block to be plugged in a rectangular cavity of the socket; the magnesium-plating filaments on both sides thereof are in close contact with two contact copper plates respectively.

Yet a further object of the present invention is to provide a lamp string with an open-circuit-proof structure, in which the fastening member of the fuse assembly is a rectangular block, of which the lower part has a rod; both sides of the rod are designed to fit to the power wire groove; after the fuse assembly is plugged in place, the rod will fill in the power wire groove between the two power-supply wires so as to prevent rain water from flowing into the rectangular cavity of the socket.

DETAILED DESCRIPTION OF THE PREFERRED EMBODIMENT

Figure 1:
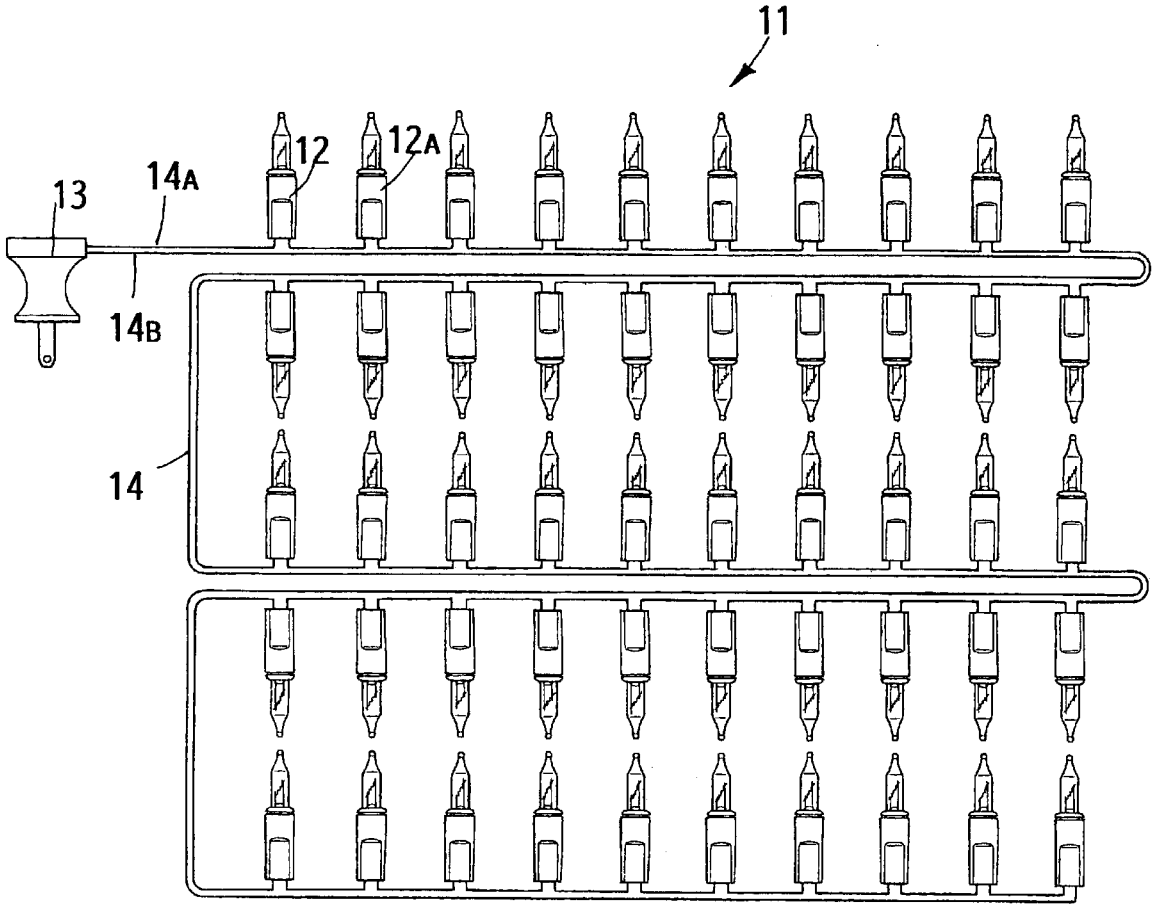
FIG. 1 is a plan view of the present invention, showing the connection structure of a lamp string.
Figure 3:
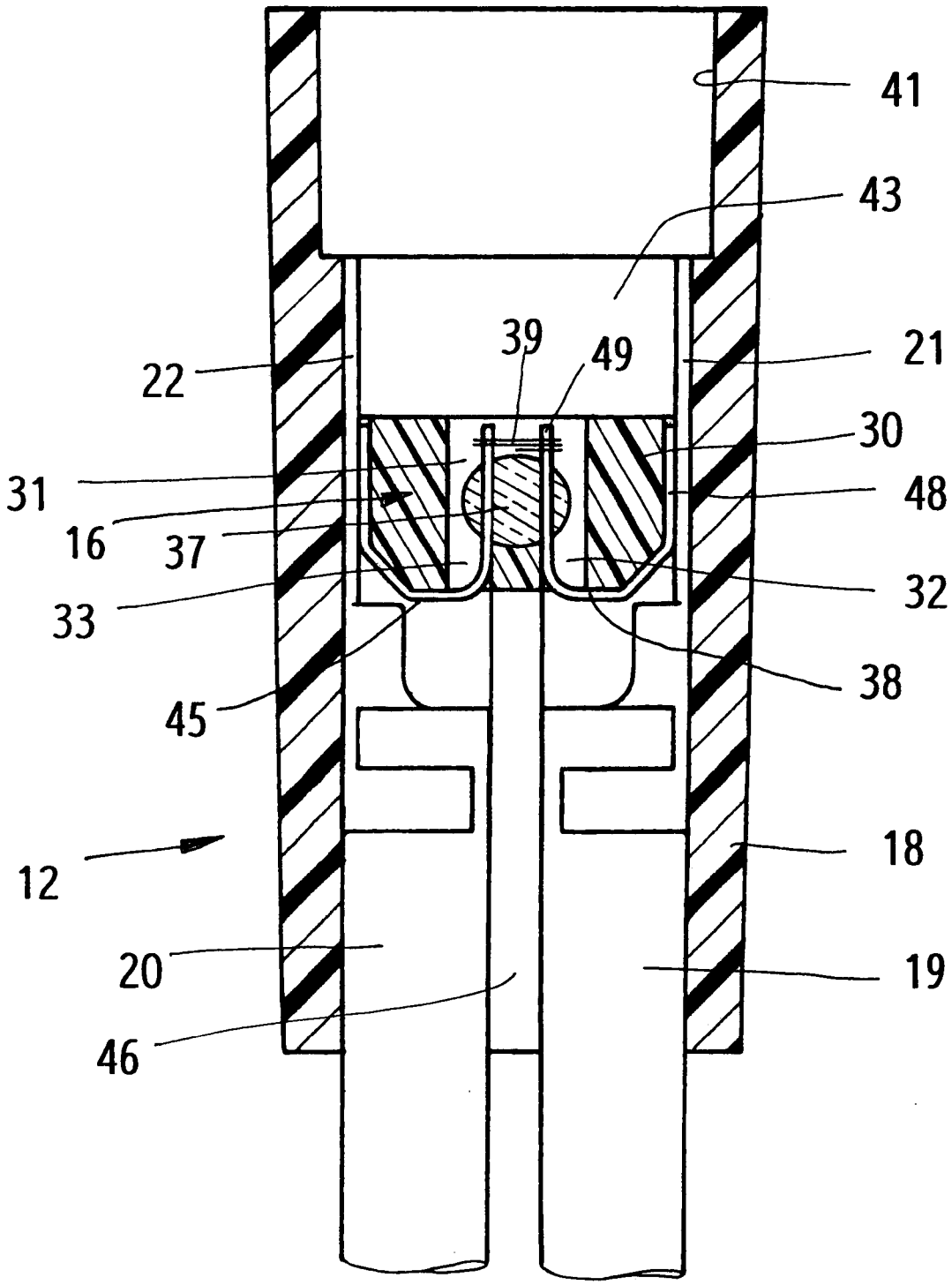
FIG. 3 is a fragmental section view of the present invention, showing a fuse assembly plugged into the socket.

Referring to FIGS. 1 and 3, the lamp string with an open-circuit-proof structure according to the present invention is a new structure, in which the lamp assemblies 12 are connected in series by means of short power-supply wires, and the first lamp assembly 12A and the last lamp assembly 12B are connected to the plug 13 by means of power-supply wires 14A and 14B respectively. The lamp assemblies 12 are twisted and connected in series to form into a lamp string 11. In the lamp string 11, every socket 18 includes a rectangular cavity 45 for receiving a fuse assembly 16. In case of the tungsten filament 47 of a bulb being burned out or a bulb receptacle 17 of a socket 18 being lost, the power supply of the whole lamp string is still maintained in the normal lighting-up condition because of the fuse assembly 16 able to back stop the aforesaid burning out.

Figure 2:
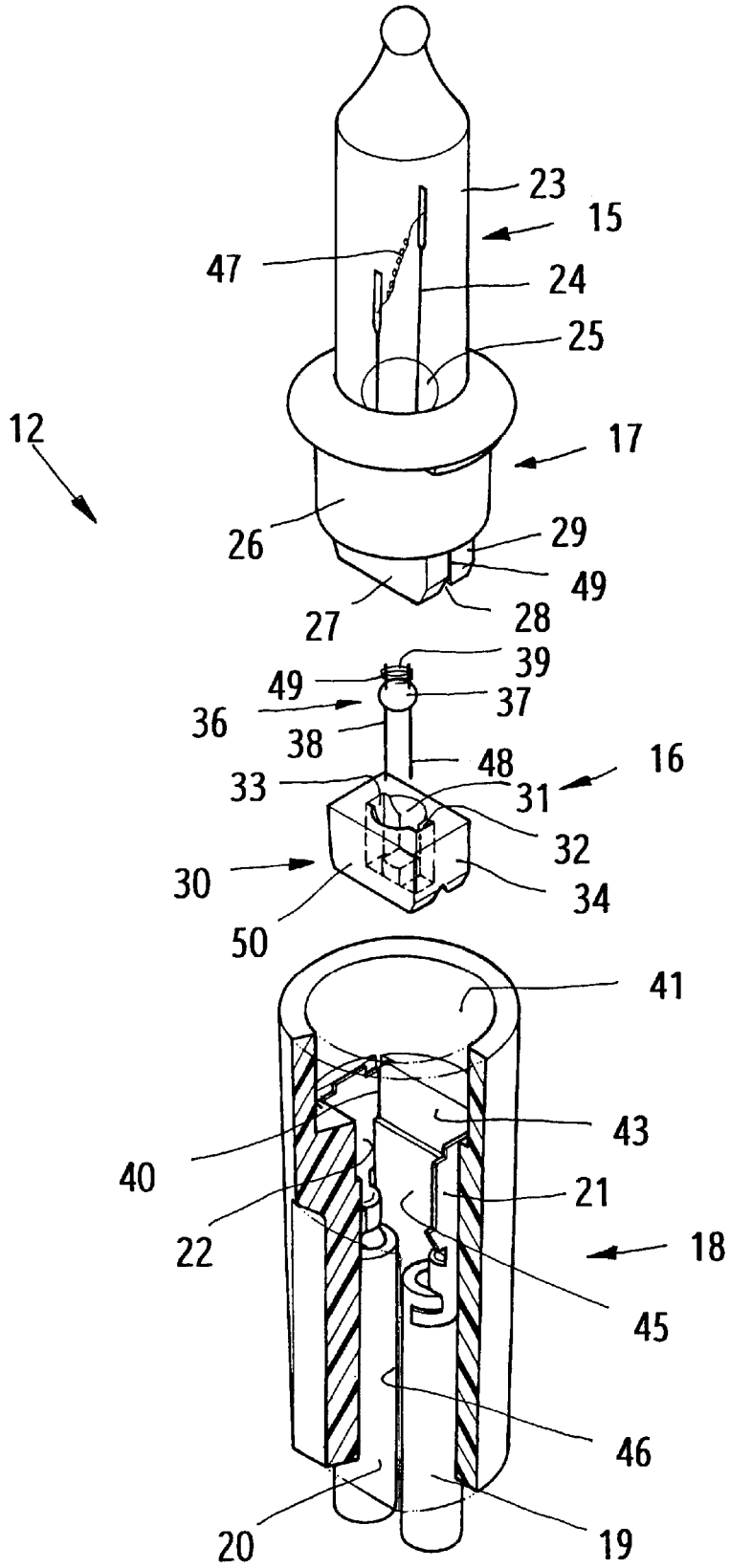
FIG. 2 is a disassembled view of the present invention, showing the relation among the assemblies of the first embodiment.
Figure 4:
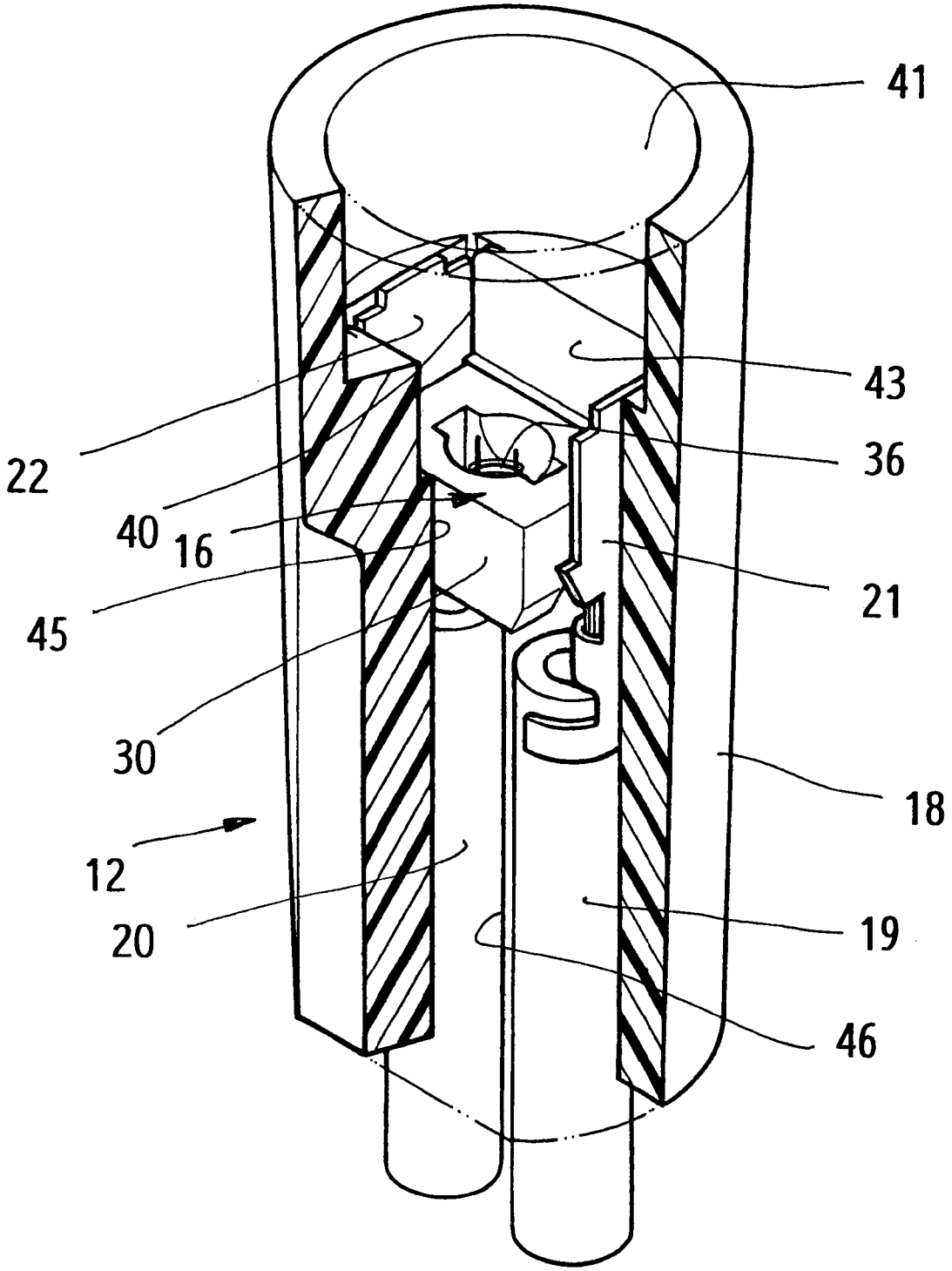
FIG. 4 is a sectional view of the present invention, showing a fuse assembly plugged in the hollow space of the socket.

As shown in FIGS. 2 to 4, each lamp assembly 12 in the lamp string 11 includes a socket 18, a fuse assembly 16, a bulb receptacle 17, and two contact copper plates 21 and 22 connected with power-supply wires 19 and 20; the bulb 15 in the aforesaid lamp string is a bulb used in a conventional lamp string. The bulb 15 has two parallel magnesium-plating filaments 24 to be fixed in place with a positioning bead 25 before the tungsten filament 47 being mounted on the tail ends of the two magnesium-plating filaments 24; the two magnesium-plating filaments 24 are fixed in a glass tube 23 at a given length; one end of the glass tube 23 is sealed together with the two magnesium-plating filaments 24 by means of a round welding method, i.e., one end of the glass tube is sealed with a round seal, while the other end thereof is a point-shaped seal.

Two longer magnesium-plating filaments 49 out of the round seal of the bulb 15 are plugged through the center hole of the bulb receptacle 17, and then extend under the rectangular block 27 of the bulb base 17, and further extend along the guide grooves and the bevel surfaces 28 to the two planes 29 respectively; after the bulb receptacle 17 with a bulb 15 is plugged into the plug-connection cavity 41 of the socket 18, the magnesium-plating filaments 49 on both sides of the bulb receptacle 17 will be in contact with the two contact copper plates 21 in the socket 18 respectively to form into a circuit in series.

The center cavity of the socket 18 in each lamp assembly 12 is used for receiving a plug-connection cavity 41, a rectangular cavity 43, a rectangular cavity 45 for plugging the fuse assembly 16, a power wire groove 46 of power-supply wires 19 and a copper plate groove 40 of the contact copper plates 21; the power wire groove 46 in the socket 18 is also used to have the power-supply wires 19 and 20 riveted with two contact copper plates 21 and 22 respectively passed through. The two contact copper plates 21 and 22 are plugged and fixed in the copper plate grooves 40 on both sides of the rectangular cavities 43 and 45 respectively; then, the two power-supply wires 19 and 20 are connected to the socket 18 of next lamp assembly 12. The plug-connection cavity 41 and the rectangular cavity 43 in the upper part of the center cavity of the socket 18 are used for plugging the bulb receptacle 17 of the bulb 15. The two contact copper plates 21 and 22 on both sides of the rectangular cavity 43 are in close contact with the magnesium-plating filaments 49 respectively to form into an electric circuit. After the rectangular block 27 of the bulb receptacle 17 is plugged into the rectangular cavity 43 of the socket 18, the bulb receptacle 17 would not rotate unintentionally.

Referring to FIG. 2, there is a rectangular cavity 45 under the rectangular cavity 43, and it is used for plugging a fuse assembly 16. Above the rectangular cavity 45, there is a small plane 44 to partition the two rectangular cavities 43 and 45 clearly. The panels of the two rectangular cavities 43 and 44 are partitioned by means of a small plane 44, and they can also be designed into a single plane so as to mount a fuse assembly on the lower portion thereof, and to mount a bulb receptacle 17 on the upper portion thereof.

The fuse assembly 16 plugged in the rectangular cavity 45 of the socket 18 includes a fastening member 30, and a fuse member 36; the fuse member 36 is plugged in the fastening member 30, which is to be plugged in the rectangular cavity 45 of the socket 18. The magnesium-plating filaments 48 on both sides of the planes 34 of the fastening member 30 are to be contact with the two contact copper plates 21 and 22 respectively on both sides of the rectangular cavity 45 to form into an electric circuit so as to prevent from open circuit in the lamp string.

The fastening member 30 of the fuse assembly 16 is a rectangular member, which is furnished with two symmetrical slots 32 and 33 between the upper and lower planes thereof; a recess 33 is furnished between the upper plane of the two slots 32 and 33. The upper ends of the two slots 32 and 33 are almost covered by the recess 31. The two slots 32 and 33 and the recess 31 form into a space so as to enable the two parallel magnesium-plating filaments 49 of the fuse member 36 to extend from the upper part of the recess 31 and along the two slots 32 and 33 to the other end thereof. The positioning bead 37 of the fuse member 36 is mounted in the recess 31, and the two magnesium-plating filaments 48 are bent along the two planes 34 of both sides thereof.

The planes of the rectangular fastening member 30 is designed to fit to the planes of the rectangular cavity 45 in the socket 18; particularly, the two wider planes 50 of the fastening member 30 are furnished with a suitable tapered plane so as to facilitate the plane 34 to plug in; as soon as the fastening member is plugged tight in place, the fuse assembly 16 will be mounted firmly in the rectangular cavity 45 of the socket 18; then, the magnesium-plating filaments 48 bent along the two planes 34 are in contact with the two contact copper plates 21 and 22 respectively.

Figure 5:
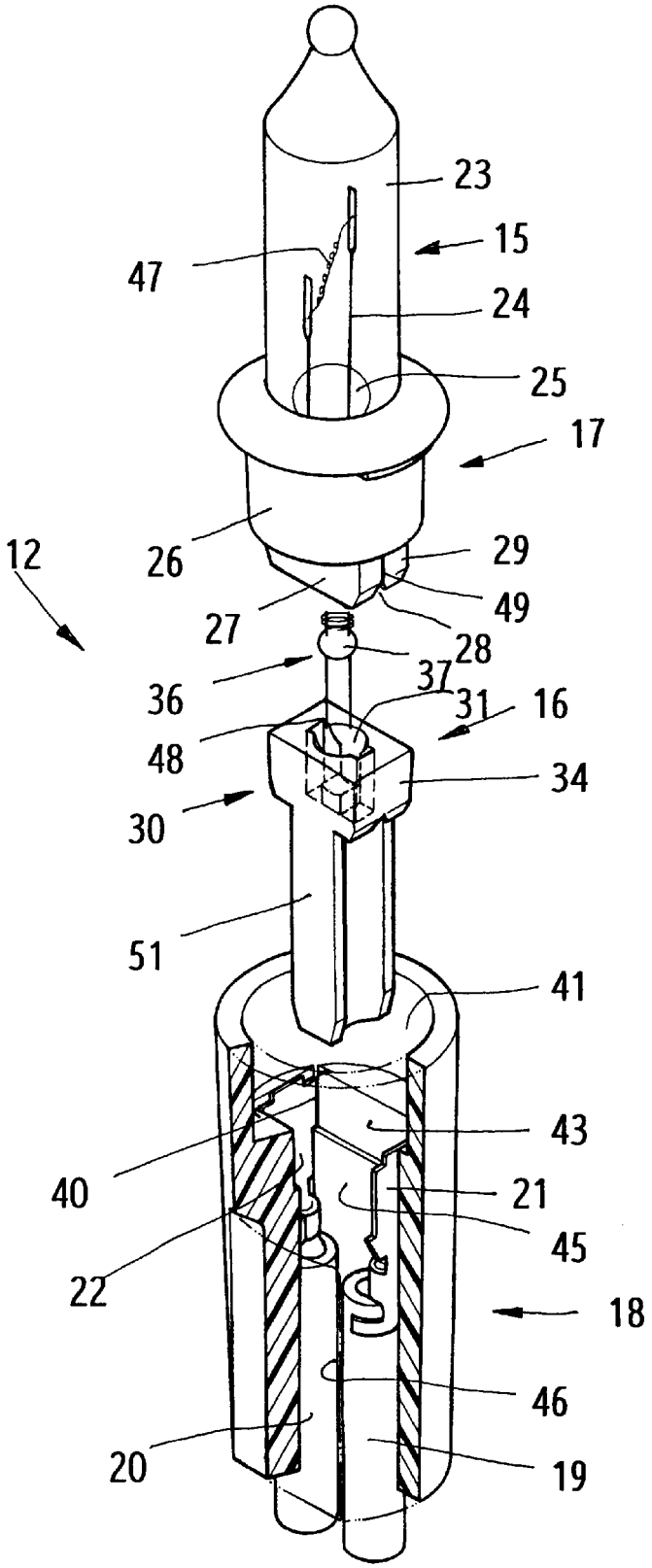
FIG. 5 is a disassembled view of the present invention, showing the relation among the assemblies of the second embodiment.
Figure 6:
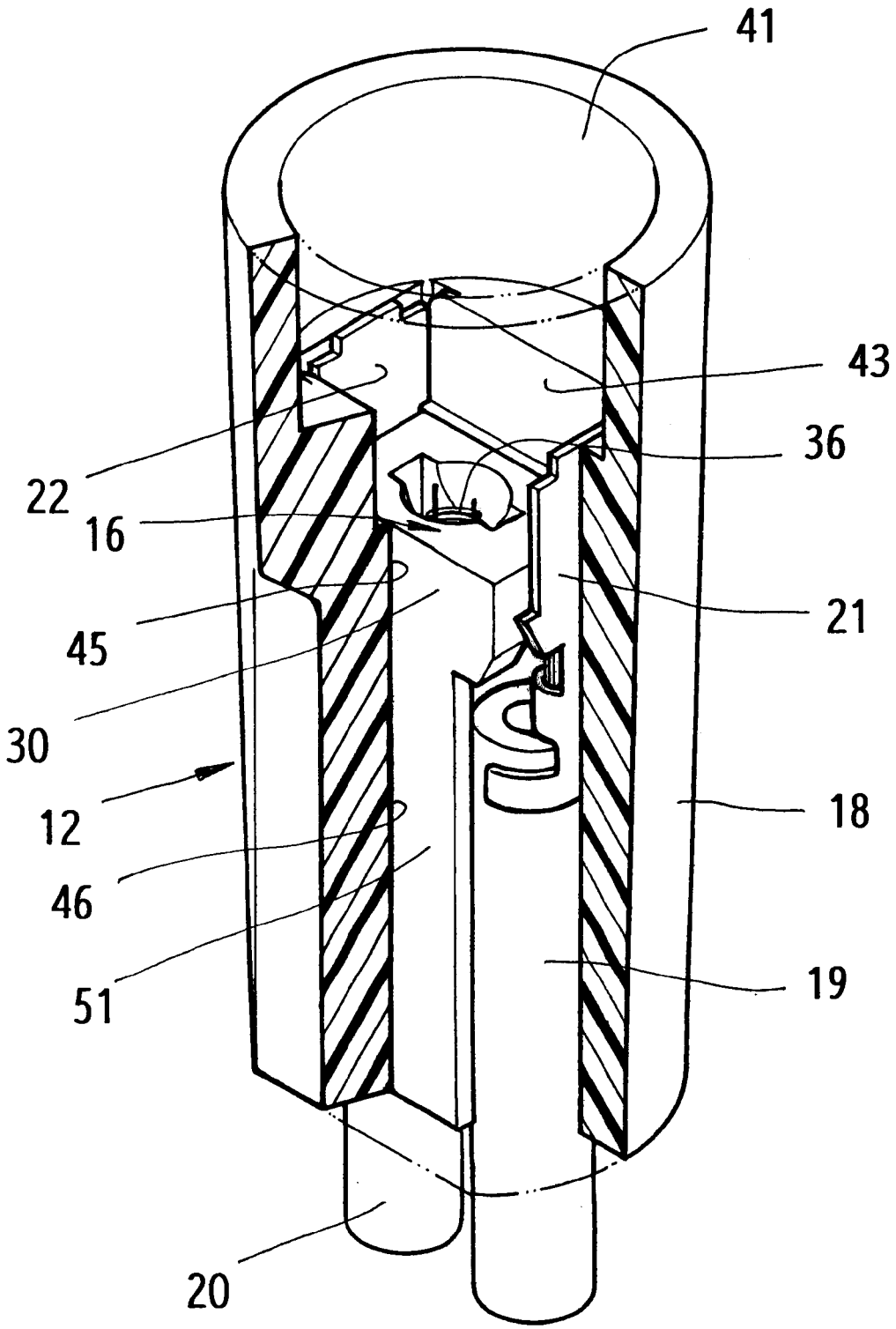
FIG. 6 is a fragmental section view of the present invention, showing a fuse assembly plugged into the socket.
Figure 7:
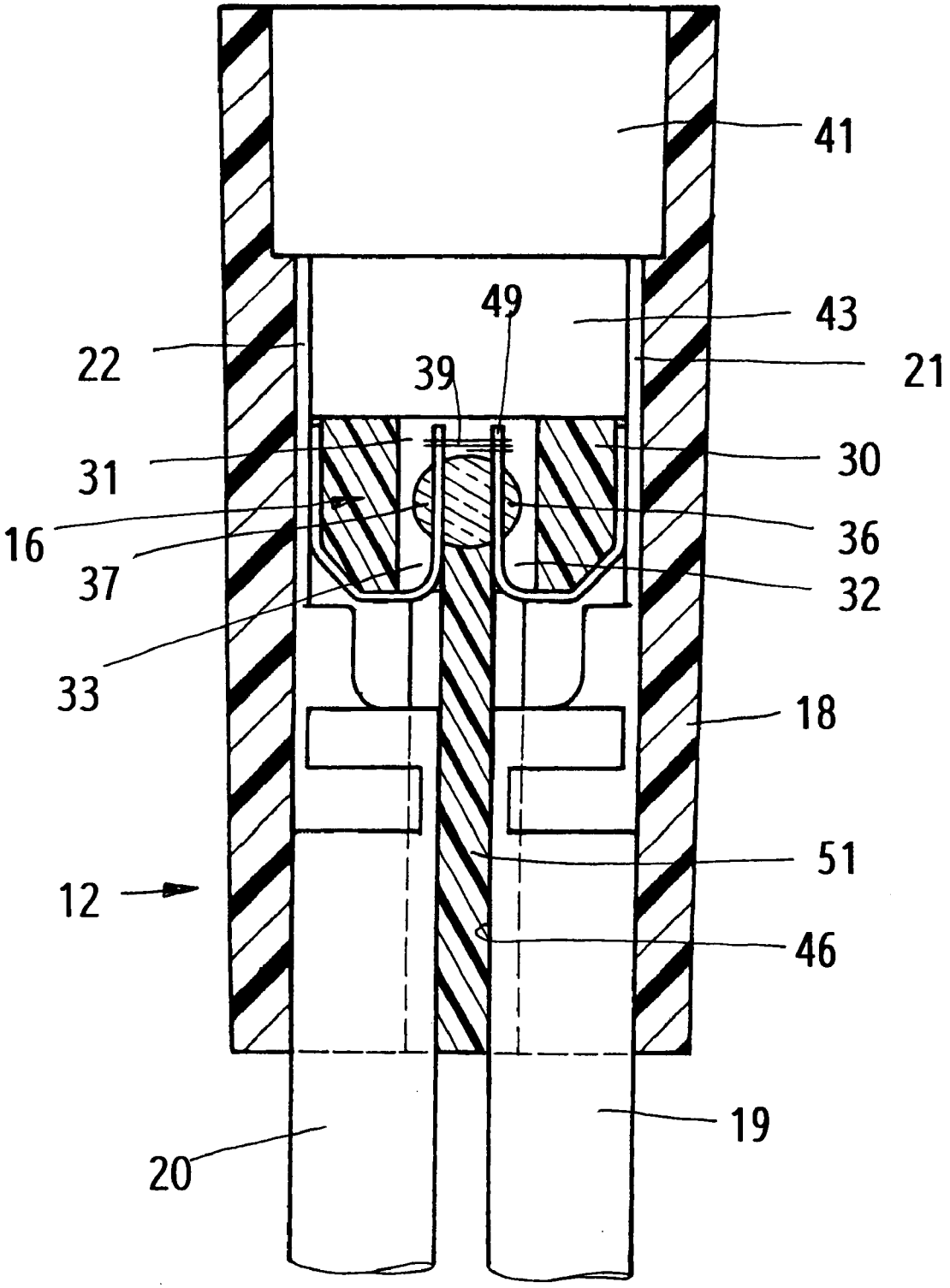
FIG. 7 is a sectional view of the present invention, showing a fuse assembly plugged in the hollow space of the socket.

As shown in FIGS. 2 to 4, the fastening member 30 of the fuse assembly 16 is a rectangular member to be plugged into the rectangular cavity 45 of the socket 18. As shown in FIGS. 5 to 7, the fastening member 30 has a rod 51 extended downwards; the rod 51 is designed to fit to the shape of the power wire groove 46 in the lower part of the socket 18; the rod 51 is inserted into the rectangular cavity 45 first, and then press it into the power wire groove 46; the fastening member 30 with a rod 51 is quite easy to assemble in place than a fastening member without rod.

The fuse member 36 of the fuse assembly 16 includes two parallel magnesium-plating filaments 38, a positioning bead 37 and a fuse wire 39; the design and making of the positioning bead 37 are the same as that of the positioning bead 25 in the bulb 15, i.e., a positioning bead 37 is furnished and welded around the two parallel magnesium-plating filaments 38 so as to have the filaments 38 partitioned into a short magnesium-plating filaments 49 section and a long magnesium-plating filament 48 section. Between the two short magnesium-plating filaments 49, wind 2.5 turns of an aluminum fuse 39 of 0.065 m/m; the aluminum fuse 39 is assembled together with the fuse member 36 and the fastening member 30, and then is mounted in he rectangular cavity 45 of the socket 18. Normally, the fuse wire 39 would not affect the current flowing in the tungsten filament 47 of the bulb 15; in case of the tungsten filament 47 of a bulb is burned out or the bulb receptacle being lost, the fuse wire 39 with low resistance will be used as a conductor.

After the fuse member 36 is mounted into the recess 31 of the fastening member 30, the two long magnesium-plating filaments 48 on the other end of the positioning bead 37 will extend through two parallel slots 32 and 33 of the fastening member 30 and to the lower part thereof; then, they are bent and attached along the two planes 34; the positioning bead 37 of the fuse member 36 is confined in the recess 31 of the fastening member 30; in that case, the fuse wire 39 wound around the two magnesium-plating filaments 49 will be confined it a fixed position without moving unintentionally.

Before the fuse assembly 16 and the socket 18 being assembled together, two contact copper plates 21 and 22 should be mounted in the copper plate grooves 40 on both sides of the two rectangular cavities 43 and 45, and then pull the two power-supply wires 19 and 20 out of the socket. When the fuse assembly 16 is mounted in the rectangular cavity 45, the wider planes 50 thereof should be in contact with the rectangular cavity 45; then, the two magnesium-plating filaments 48 on both planes 34 will be in close contact with the two contact copper plates 21 and 22 respectively; then, the fuse assembly 16 is deemed mounted in place. When the fuse assembly 16 is a separate rectangular member, it should be held with a pair of tweezers to put in the opening end of the rectangular cavity 45 before being pushed in place with a push rod. If the lower part of the fuse assembly 16 has a rod 51 under the fastening member 30, the fastening member 30 can easily be inserted into the rectangular cavity 45 of the socket 18, and then use a push rod to push inwards; the rod 51 can provide a seal and filling function between the two power supply wires 19 and 20 so as to prevent rain water from flowing in.

The rectangular cavity 43 of the socket 18 is used for mounting the fuse assembly 16, while the rectangular cavity 45 and the plug-connection cavity 41 above the fuse assembly 16 are used for mounting the bulb receptacle 17; the round tube 26 of the bulb receptacle 17 is to be plugged into the plug-connection cavity 41, while the rectangular block 27 is to be plugged into the rectangular cavity 43. After the bulb receptacle 17 is plugged into the rectangular cavity 43 of the socket 18, the two magnesium-plating filaments 49 on the planes 29 will be in contact with the two contact copper plates 21 and 22 respectively to form into an electric circuit.

The bulb receptacle 17 is to be mounted into the plug-connection cavity 41 and the rectangular cavity 43, which is designed to have a given height. The fuse assembly 16 is mounted into the lower part of the rectangular cavity 45 first, and then the bulb receptacle 17 is plugged into the rectangular cavity 45; then, the magnesium-plating filaments of the fuse assembly 16 and the bulb receptacle 17 will be in contact with the two contact copper plates 21 and 22 respectively; a short space is designed between the two aforesaid assemblies so as to prevent them from collision.

Every socket 18 of the lamp assembly 12 in the lamp string 11 is mounted with a fuse assembly 16; the tail ends of the two magnesium-plating filaments 24 of the bulb 15 are mounted with a tungsten filament 47; when a lamp string 11 is mounted in a place, it would not have an open circuit in case of the tungsten filament 47 of a bulb 15 being burned out, or a bulb receptacle 17 being lost; in other words, the lamp string is always maintained in lighting-up condition.

Figure 8:
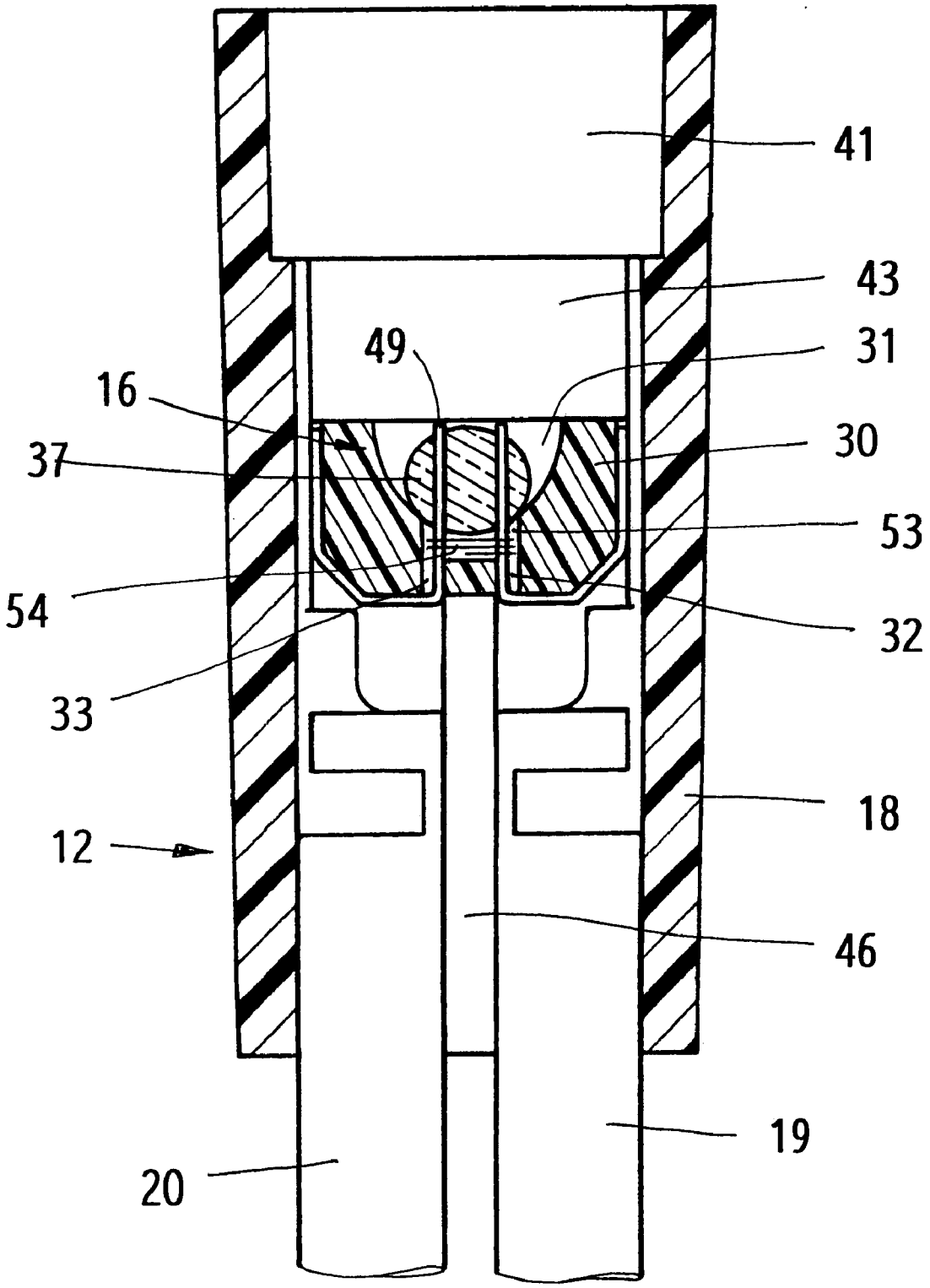
FIG. 8 is a sectional view of the present invention, showing the second method of winding the fuse wire in the first embodiment.
Figure 10:
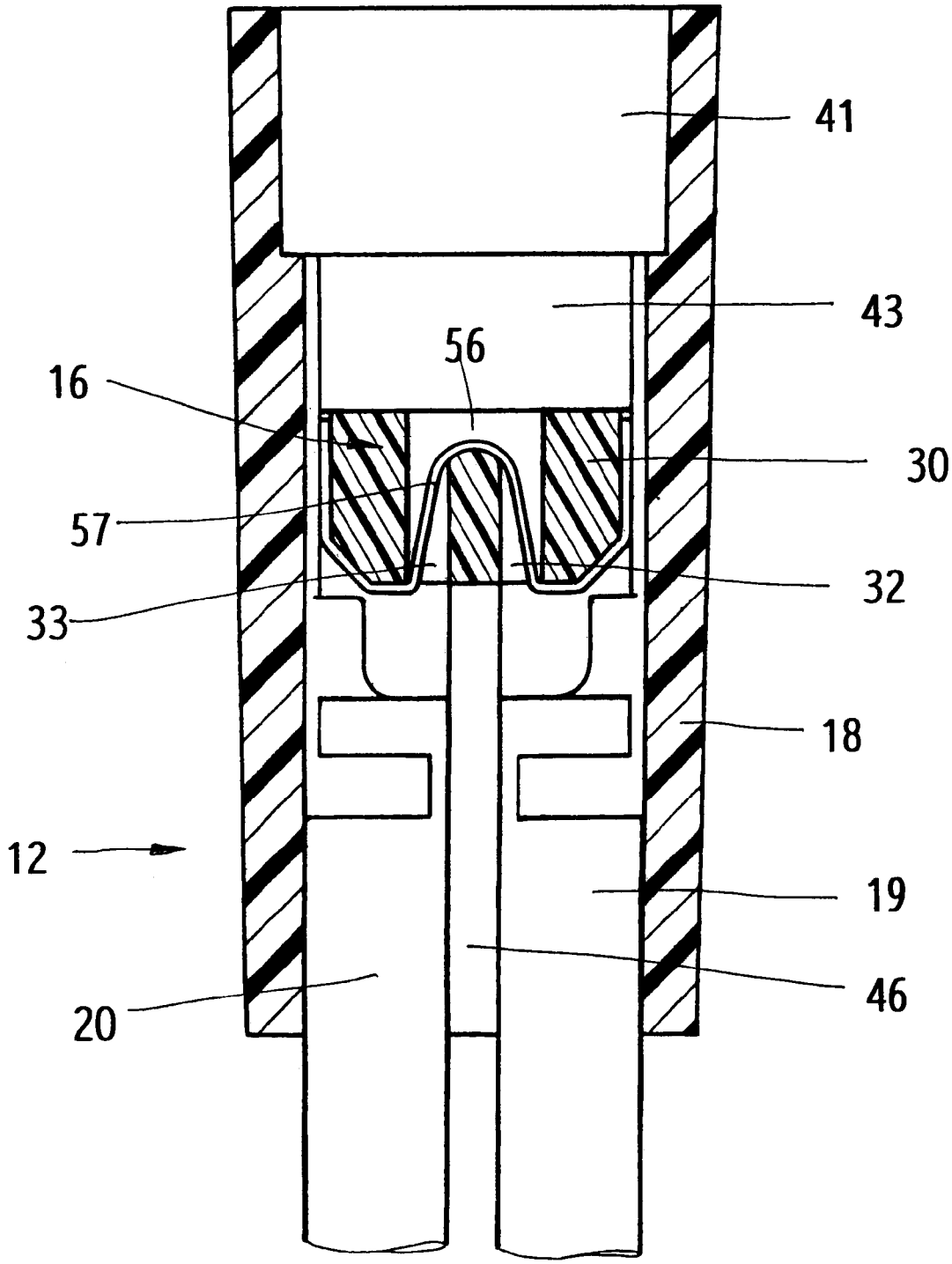
FIG. 10 is a sectional view of the present invention, showing the second method of winding the fuse wire in the second embodiment.

In the aforesaid fuse member 36 of the fuse assembly 16, fuse wire 39 is wound around the two short section of magnesium-plating filaments 49 at one end of the positioning bead 37. As shown in FIGS. 8 and 10, two different embodiments are shown, and the recess 31 of the fastening member 30 thereof has a communicating groove 53 which is used for laying the two long magnesium-playing filaments 48 of the fuse assembly 36; the tail ends of the filaments are bent and attached to the two planes 34. The two longer sections of the magnesium-plating filaments are wound around with a fuse wire 54 nearing the positioning bead 37. When the two long magnesium-plating filaments 48 of the fastening member 30 are laid through the two slots 32 and 33 respectively without affecting the fuse wire 54 fastened on the two magnesium-plating filaments 48.

Figure 9:
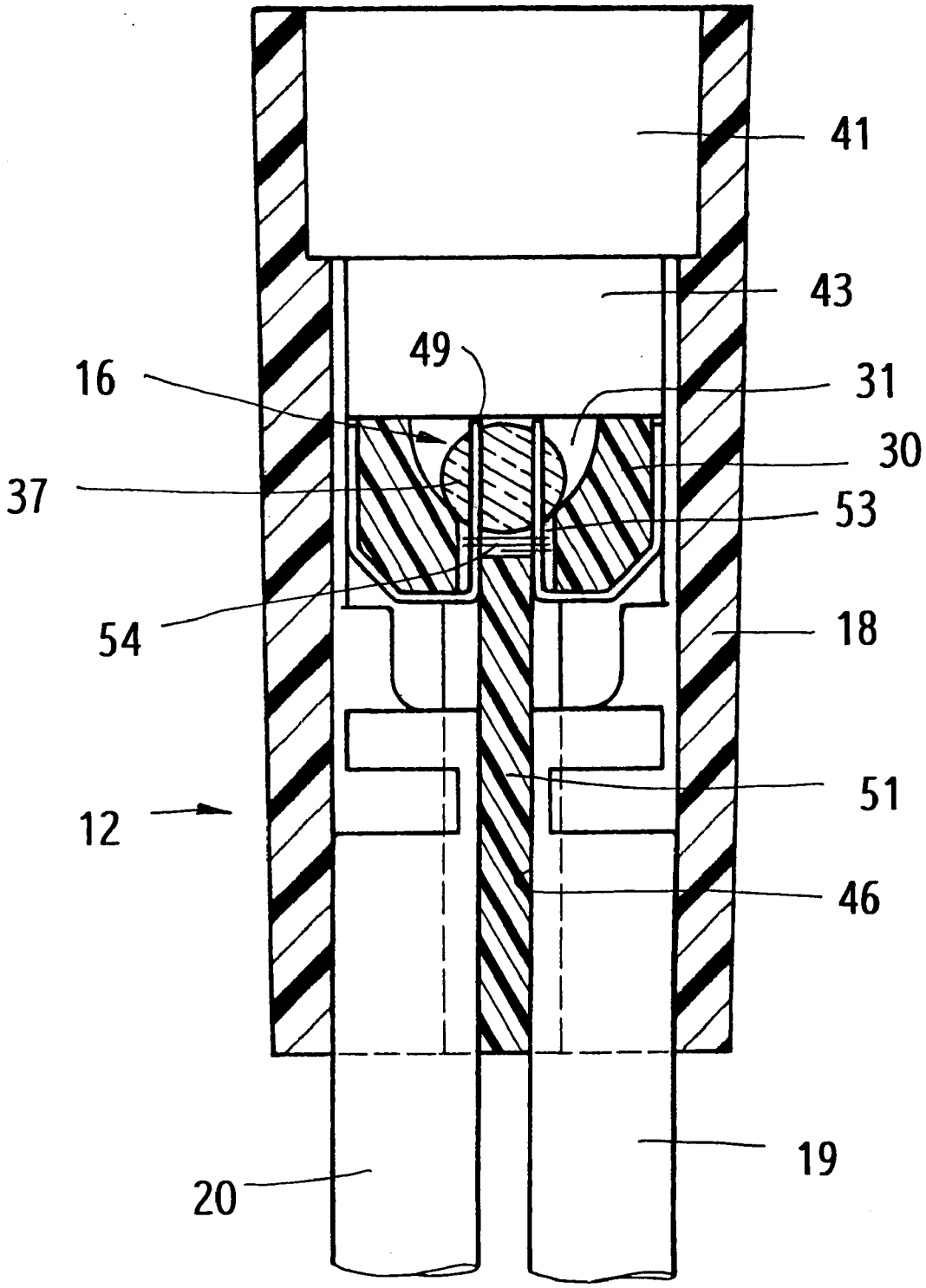
FIG. 9 is a sectional view of the present invention, showing the third method of winding the fuse wire in the first embodiment.
Figure 11:
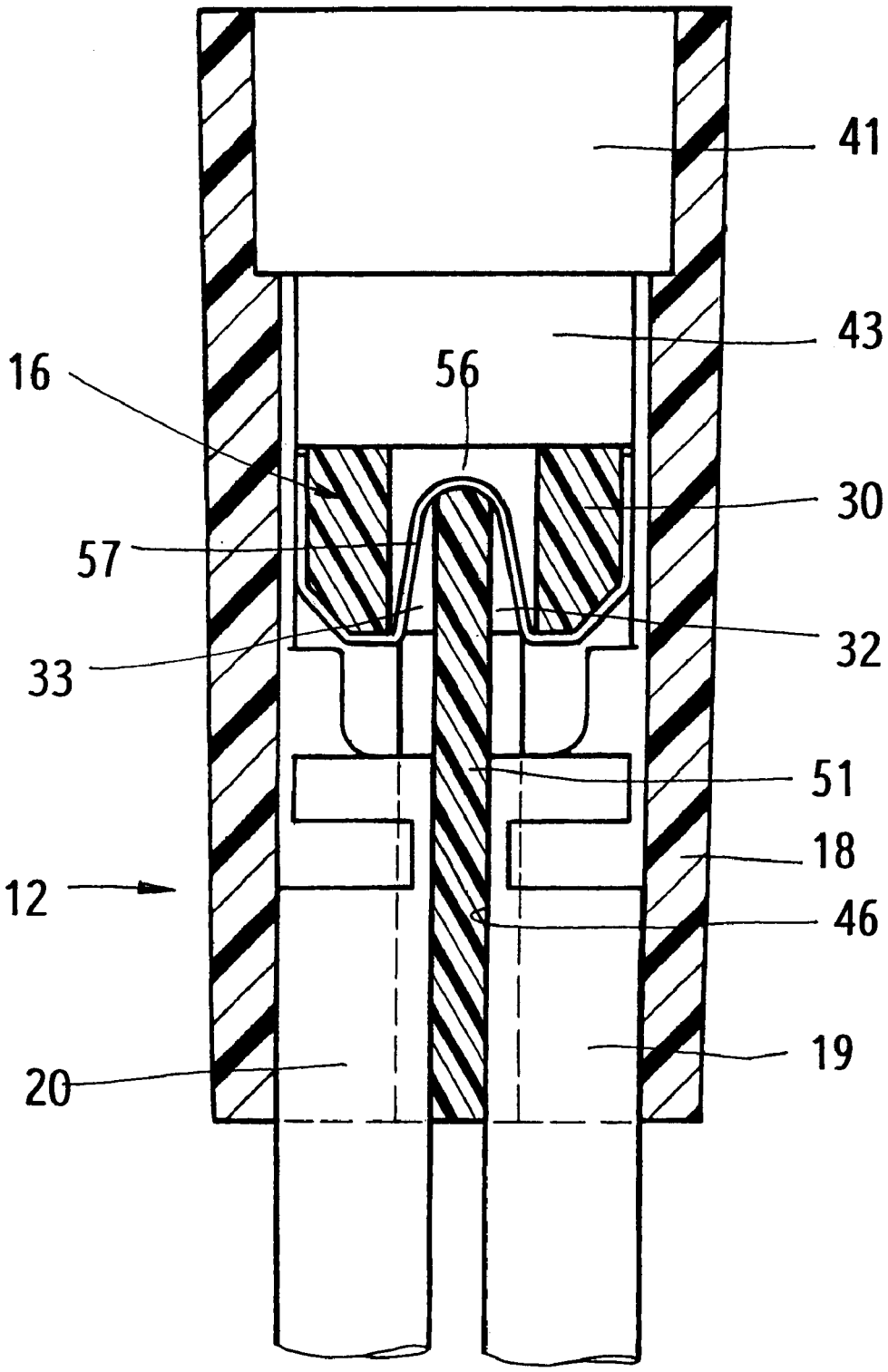
FIG. 11 is a sectional view of the present invention, showing the third method of winding the fuse wire in the second embodiment.

Referring to FIGS. 9 and 11, the fastening member 30 of the fuse assembly 16 has two through slots 32 and 33, above which there is a communicating groove 56 with a curved surface between the two through slots 32 and 33; a fuse wire 57 made of aluminum is bent into U-shape, and is plugged into the two through slots 32 and 33. The tail ends of fuse wire 57 are bent and attached to the planes 34 on both sides thereof. After the fuse assembly 16 is mounted in the rectangular cavity 45 of the socket 18, the two fuse wires 57 laid along both sides of the fastening member 30 will be in close contact with the two contact copper plates 21 and 22 respectively. After the fuse assembly 16 is mounted into the rectangular cavity 45 of the socket 18, it will provide a low resistance electric circuit between the two power-supply wires 19 and 20. Normally, the current can flow through the bulb 15; in case of the tungsten filament 47 of a bulb 15 being burned out, or a bulb receptacle 17 of the socket 18 being lost, the whole lamp string can still maintain in lighting-up condition.

According to the description of the aforesaid embodiments, the features and structure of the present invention have been disclosed completely; it is apparent that the present invention has provide an obvious improvement, which is never anticipated and achieved by any person in the field; therefore, the structure of the present invention is deemed unique.

What is claimed is:

1. A lamp string with an open-circuit-proof structure, comprising:

a socket having a rectangular cavity for mounting a fuse assembly, and a rectangular cavity for plugging a bulb receptacle; both sides of said two rectangular cavities being furnished with two contact copper plates respectively;

a fuse assembly mounted in a rectangular cavity in said socket, and including a fastening member designed in a rectangular shape, and two parallel slots, and a recess; and a fuse member having a positioning bead for fixing two parallel magnesium-plating filaments; a short section of said two parallel magnesium-plating filaments at one end of said positioning bead being wound with a fuse wire; a longer section of said two magnesium-plating filaments on other end of said positioning bead extended through two parallel slots of said fastening member, and then being bent along planes thereof;

a bulb receptacle for mounting a bulb, and two magnesium-plating filaments of said bulb being bent and attached to two planes, and finally being plugged into a plug-connection cavity.

2. The lamp string with an open-circuit-proof structure as claimed in claim 1, wherein said socket has two rectangular cavities, of which one outer rectangular cavity being mounted with a bulb receptacle, while an inner rectangular cavity being plugged with a fuse assembly.

3. The lamp string with an open-circuit-proof structure as claimed in claim 1, wherein said fastening member of said fuse assembly is designed to fit to an inner rectangular cavity of said socket, and two wide planes thereof being in close contact with said rectangular cavity; said magnesium-plating filaments on said two planes to be in contact with two contact copper plates respectively in said rectangular cavity.

4. The lamp string with an open-circuit-proof structure as claimed in claim 1, wherein said fastening member of said fuse assembly is designed to fit to an inner rectangular cavity, and lower part thereof furnished with a rod to be plugged in a power-wire groove under said socket closely.

5. The lamp string with an open-circuit-proof structure as claimed in claim 1, wherein said fastening member of said fuse assembly has a recess in communication with two parallel slots, and having a communicating groove underneath; said fuse member of said fuse assembly having a positioning bead for fastening said two parallel magnesium-plating filaments; a fuse wire wound around said two longer section of said parallel magnesium-plating filaments nearing said positioning bead; said fuse assembly being plugged in said fastening member, while said fuse wire on said two parallel magnesium-plating filaments being plugged in said lower communicating groove.

6. The lamp string with an open-circuit-proof structure as claimed in claim 1, wherein said fastening member of said fuse assembly has a communicating groove above said two through slots, and said communicating groove having a curved surface over said two through slots; a fuse wire made of aluminum being bent into a U-shaped fuse to extend through communicating groove and towards said two through slots, and tail ends of said fuse wire being bent along said two planes respectively.

* * * * *